US006797126B2

(12) United States Patent
Sharivker et al.

(10) Patent No.: US 6,797,126 B2
(45) Date of Patent: Sep. 28, 2004

(54) PROCESS FOR THE DESULPHURIZATION AND UPGRADING FUEL OILS

(75) Inventors: Viktor Sharivker, Ottawa (CA); Travis Honeycutt, Gainesville, GA (US)

(73) Assignee: Reactive Energy LLC, Flowery Branch, GA (US)

( * ) Notice: Subject to any disclaimer, the term of this patent is extended or adjusted under 35 U.S.C. 154(b) by 342 days.

(21) Appl. No.: 10/116,257

(22) Filed: Apr. 3, 2002

(65) Prior Publication Data

US 2003/0042172 A1 Mar. 6, 2003

Related U.S. Application Data

(60) Provisional application No. 60/285,970, filed on Apr. 24, 2001.

(51) Int. Cl.[7] ..... C07C 1/00

(52) U.S. Cl. ..... 204/157.15; 208/209; 208/213; 208/217; 208/108

(58) Field of Search ..... 208/108, 209, 208/213, 217; 204/157.15

(56) References Cited

U.S. PATENT DOCUMENTS

| | | | | |
|---|---|---|---|---|
| 3,616,375 | A | 10/1971 | Inque | |
| 4,087,348 | A | 5/1978 | Baird et al. | 208/108 |
| 4,148,614 | A | 4/1979 | Kirkbride | 44/1 |
| 4,234,402 | A | 11/1980 | Kirkbride | 204/162 |
| 4,279,722 | A | 7/1981 | Kirkbride | 204/162 |
| 4,545,879 | A | 10/1985 | Wan et al. | 204/158 |
| 5,181,998 | A | 1/1993 | Murphy | |
| 6,068,737 | A | 5/2000 | De Chamorro | |
| 6,171,479 | B1 | 1/2001 | Ovalles | |
| 6,184,427 | B1 | 2/2001 | Klepfer | |
| 2004/0031731 | A1 * | 2/2004 | Honeycutt et al. | 208/402 |

* cited by examiner

*Primary Examiner*—Walter D. Griffin
*Assistant Examiner*—James Arnold, Jr.
(74) *Attorney, Agent, or Firm*—Malcolm B. Wittenberg

(57) ABSTRACT

A method of desulphurizing and cracking of hydrocarbons to produce fuel oil. The fuel oil is first admixed with a sensitizer and solid source of hydrogen and, preferably, with a catalyst and a desulphurizing agent. The admixture is then subjected to microwave energy. The method acts to reduce the sulphur content of the fuel oil and cracks the fuel oil into a useful source of clean, burnable energy.

35 Claims, No Drawings

PROCESS FOR THE DESULPHURIZATION AND UPGRADING FUEL OILS

RELATED APPLICATIONS

The present application is based upon the filing of provisional application Serial No. 60/285,970, dated Apr. 24, 2001.

TECHNICAL FIELD OF INVENTION

The present invention relates to a method of desulphurizing and cracking hydrocarbons by subjecting the hydrocarbons which have been admixed with certain key components to microwave energy. Through the judicious choice of additives and the use of microwave power, hydrocarbons high in sulphur content and high in molecular weight can be made into useful products which can be burned cleanly and efficiently as a fuel oil.

BACKGROUND OF THE INVENTION

This invention relates to the high frequency treatment of hydrocarbons, more particularly, to the desulphurization and upgrading of fuel oils. Hydrocracking processes for the conversion of heavy hydrocarbon oils to naphtha and diesel fuel are well known. The most appropriate uses of those products are as sources of energy. However, high sulphur content in fuels in the form of organic sulphur compounds creates serious environmental problems, the removal of which requires very costly equipment. It is also highly desirable to provide a hydrocracking process, which provides for the simultaneous cracking and removal of sulphur in forms other than $SO_2$. Further, the presence of nitrogen and oxygen in fuel oils are also undesirable as nitrogen is converted into nitrogen oxide gases, whose release to the atmosphere is regulated. In addition, nitrogen poisons catalysts. The removal of oxygen from feedstock upgrades the fuel by increasing its heating value.

The most commonly used process to reduce sulphur levels in hydrocracked feedstock is hydrodesulphurization. This is a catalytic process, taking place at high temperatures and hydrogen pressure. For example, Baird, Jr. et al. described a hydrodesulphurization process in U.S. Pat. No. 4,087,348 where the heavy hydrocarbon feedstock is contacted with hydrogen and a reagent selected from alkaline earth metal hydrides, oxides and mixtures thereof. However, that process is carried out at temperatures in the range of 700° F. to 1500° F. which induces caking and high partial pressures ranging from 1500 to 3000 psi.

Kirkbridge teaches, in U.S. Pat. No. 4,234,402, that the sulphur content of crude petroleum can be reduced by subjecting a mixture of the crude petroleum and hydrogen gas to microwave energy. In U.S. Pat. No. 4,279,722, Kirkbridge describes use of microwave energy in petroleum refinery operations which requires a platinum catalyst and high hydrogen pressures of, for example, 200–2,000 psi.

The process for removing sulphur from coal was described in U.S. Pat. No. 4,148,614. Sulphur content was taught to be reduced by drying coal particles and subjecting a mixture thereof to hydrogen under the influence of microwave energy. Wan et al. disclose in U.S. Pat. No. 4,545,879 employing microwave heating to desulphurize pulverized petroleum pitch using para- or ferromagnetic catalysts. The required amount of catalyst was taught to be the same as the amount of treated feedstock. Maximum removal of sulphur was shown to be 70%.

All of the above-noted processes required the presence of hydrogen gas at high pressure. Sulphur content in the hydrocarbon feedstock after reduction was from 200 to 1500 ppm, noting that sulphur and hydrogen were removed in the form of hydrogen sulfide which required further processing.

It is thus an object of the present invention to provide a process for creating useable fuel oil capable of being burned as a clean and efficient source of energy from hydrocarbon stock which would otherwise be relatively unusable.

It is yet a further object of the present invention to provide an efficient method of reducing the sulphur content of hydrocarbon fuel and to crack the hydrocarbon fuel to lower its average molecular weight in order to provide a relatively clean burning and useful commercial product.

These and further objects of the present invention will be more readily appreciated when considering the following disclosure and appended claims.

SUMMARY OF THE INVENTION

The present invention is directed to a method of desulphurizing and cracking fuel oil comprising first admixing the fuel oil with a sensitizer and solid source of hydrogen to form an admixture followed by subjecting the admixture to microwave energy. Preferably, the fuel oil further contains a catalyst and desulphurizing additive such that upon being subject to microwave energy, the cracked product is reduced in molecular weight and provided with a lower sulphur content such as to provide a commercially viable product which can be cleanly burned as a source of energy.

DETAILED DESCRIPTION OF THE INVENTION

According to the preferred embodiment of the present invention it has been discovered that hydrocracking and desulphurization of the hydrocarbon oils can be carried out by mixing hydrocarbon feedstock with para-or ferromagnetic catalysts and sensitizers, desulphurizing agents and in-situ solid sources of hydrogen and subjecting this mixture, in the absence of hydrogen gas, to microwave irradiation. Micro-discharges are generated thereby upgrading the oils while releasing and separating chemically bound organic sulphur from the hydrocarbon feedstock as sulphur-contained solid and gaseous inorganic compounds, nitrogen as ammonia and oxygen as water.

In the present process, a mixture of hydrocarbon feedstock, sensitizer, catalyst, desulphurizing additives and in-situ solid hydrogen sources are subjected to the influence of microwave energy. Sensitizers are selected as materials that strongly absorb microwave radiation and subsequently transfer the energy required to initiate certain desired chemical reactions. Catalysts allow for the localization of temperature increases creating conditions for the generation of micro-discharges near the surfaces of the sensitizer when the processed mixture is irradiated with microwaves. The micro-discharges represent a highly non-equilibrium system of ionized molecules and electrons where the kinetic energy ("temperature") of the electrons is significantly higher than the average temperature of the system. Without being bound by any particular theory, it is believed that the electron energy is sufficient to break the chemical bonds in the molecules forming free radicals. As a result, the hydrocarbon oil is upgraded. At the same time the sulphur, nitrogen and oxygen atoms, as well as the in-situ solid hydrogen source are activated in the microwave reactor. Sulphur reacts with hydrogen and oxygen, as well as with desulphurizing additives to form inorganic salts such as sulfates, sulfites and sulfides. Specifically, sulphur is converting from its organic to an inorganic form as a result of its exposure to microwave irradiation. Sulfides, sulfites, hydrogen and hydrogen sulfide are formed in reactions such as:

$$S_n^{organic}+2NaH \rightarrow Na_2S_n+H_2$$

$$S_n^{organic}+2m\ NaH \rightarrow m\ Na_2S_{(n/m-1)}+m\ H_2S$$

$$S_n^{organic}+4NaOH \rightarrow Na_2Sn_{n-1}+Na_2SO_3+H_2O+H_2$$

Hydrogen sulfide is converting into sulfate in the reactor:

$$H_2S+2\ NaOH+O_2 \rightarrow Na_2SO_4+H_2$$

Oxygen forms water with hydrogen. Activated nitrogen reacts with hydrogen and water to form ammonia. The hydrocarbon fuel source, which is purified by the removal of sulphur, nitrogen and oxygen is upgraded in its physical and chemical properties in the form of a liquid and a gas. The fuel source is separated from its solid inorganic salts, which contained sulphur, nitrogen and oxygen by evaporation from the microwave reactor and can be condensed through the use of a heat exchanger. The process can be carried out at atmospheric pressure which provides for hydrocracking and in-situ desulphurization while avoiding the use of hydrogen gas.

As noted above, the wave energy used in the present process is in the microwave range. The equipment for generating microwave energy for use herein is well known in the art. For example, reference is made to applicant's previously issued U.S. Pat. No. 6,184,427, the disclosure of which is incorporated by reference herein.

The sensitizers used in the present process are materials which strongly absorb microwave energy and are suitable to play the role of "energy converter". Suitable sensitizers again are disclosed in U.S. Pat. No. 6,184,427 and include activated carbon and metal oxides such as NiO, CuO, $Fe_3O_4$, $MnO_2$, $Co_2O_3$, and $WO_3$. The concentration range for the proposed sensitizers is preferably approximately 0.5–20 wt % based upon the weight of the fuel oil being processed.

The catalysts used in present process are also disclosed in U.S. Pat. No. 6,184,427 and can be a metal powder such as a para- or ferromagnetic material, preferably a metal powder, such as iron, copper, or nickel. The concentration range is preferably approximately 0.5–10 wt % based upon the weight of the fuel oil being processed.

As noted above, desulphurizing additives are used to eliminate sulphur contamination in the final fuel oil product. They may consist of granulated limestone and other forms of $CaCO_3$, calcite (CaO), magnesite (MgO), dolomite (MgO—CaO), sodium hydroxide (NaOH), potassium hydroxide (KOH) and sodium bicarbonate ($NaHCO_3$). The preferred concentration range of the desulphurizing additive is preferably approximately 0.5–25 wt % based upon the weight of the fuel oil being processed.

An in-situ solid source of hydrogen is used to provide hydrogen atoms for hydrocracking and desulphurization without the direct use of hydrogen gas. This solid source of hydrogen may be derived from various hydrides, such as sodium borohydride ($NaBH_4$), titanium hydride ($TiH_2$), potassium hydride (KH), copper hydride (CuH), zinc hydride (ZnH), sodium hydride (NaH), chromium hydride (CrH) and nickel hydride (NiH 0.5). The concentration range for this component is preferably approximately 0.5–20 wt % based upon the weight of the fuel oil being processed.

EXAMPLES

The first hydrocarbon to be treated was Russian 0.20 sulphur Gasoil containing 0.27 weight percent of sulphur. The first five examples which are recited herein all employ Russian 0.20 sulphur Gasoil as the hydrocarbon to be treated. The various additives employed in carrying out the present method are recited in Table 1. Further, the physical and chemical properties of this initial feedstock, as well as the final products derived from practicing the present invention are provided in Table 2.

Example 1

In carrying out the first example, the subject Russian 0.20 sulphur Gasoil was combined with 2.5 moles of $CaCO_3$ as the desulphurizing additive and 1.5 moles of $NaBH_4$ as the solid source of hydrogen per mole of sulphur. 40 grams of this combination were subjected to microwave radiation at 2450 MHz for one hour under a nitrogen atmosphere. The microwave reactor was operated at a power level of 1 kW and the by-product condensed and its physical and chemical properties analyzed, the results of which are shown in Table 2 under the heading 0.20S-I with its sulphur content recited in Table 3.

TABLE 1

| Reactive mixture | C Wt % | Fe Wt % | $CaCO_3$ Mole per mole S | $NaBH_4$ Mole per mole S | NaH Mole per mole S | $TiH_2$ Mole per mole S |
|---|---|---|---|---|---|---|
| 0.20S-I | — | — | 2.5 | 1.5 | — | — |
| 0.20S-II | 1 | — | 2.5 | 1.5 | — | — |
| 0.20S-III | 1 | 1 | 2.5 | 1.5 | — | — |
| 0.20S-Na | 1 | — | 2 | 1.5 | 2 | — |
| 0.20S-Ti | 1 | — | 2 | 1.5 | — | 1 |

TABLE 2

| Parameter | Units | 0.20 S (untreated) | 0.20S-I | 0.20S-II | 0.20S-III |
|---|---|---|---|---|---|
| API Gravity | @60° F. | 37.7 | 38 | 38 | 38.3 |
| Specific Gravity | @60° F. | 0.836 | 0.844 | 0.85 | 0.833 |
| Density | @20° C. g/cc | 0.840 | 0.844 | 0.862 | 0.830 |
| Flash Point | ° C. | 73 | 95 | 93 | 71 |
| Pour Point | ° C. | −10 | −20 | −20 | −23 |
| Viscosity | Cst@20C | 4.63 | 5.81 | 5.31 | 3.81 |

TABLE 3

| Reactive Mixture | Sulphur content before reaction wt. % | Sulphur content after reaction Wt. % | Sulphur removed % |
|---|---|---|---|
| 0.20S-I | 0.27 | 0.13 | 52% |
| 0.20S-II | 0.27 | 0.08 | 70% |
| 0.20S-III | 0.27 | 0.17 | 37% |
| 0.20S-Na | 0.27 | <MDL* | 96–100% |
| 0.20S-Ti | 0.27 | 0.07 | 74% |

*MDL—method detection limit—0.01%

Example 2

The same Russian 0.20 sulphur Gasoil was combined with 1 percent by weight activated carbon as the sensitizer, 2.5 moles of $CaCO_3$ as the desulphurizing additive and 1.5 moles of $NaBH_4$ as the hydrogen source, per mole of sulphur. Again, 40 grams of this combined product were subjected to microwave irradiation at a frequency of 2450 MHz at a power level of 1 kW for six minutes. The resultant hydrocarbon fuel was condensed and its physical properties analyzed and total sulphur content recited in Tables 2 and 3 under the heading 0.20S-II.

Example 3

The same Russian 0.20 sulphur Gasoil was combined with 1 percent by weight of activated carbon as a sensitizer, 1 percent by weight iron powder as the catalyst, 2.5 moles of $CaCO_3$ as the desulphurizing additive and 1.5 moles of $NaBH_4$ each per mole of sulphur. 40 grams of the combined product were subjected to microwave irradiation at a frequency of 2450 MHz at a power of 1 kW for six minutes under a nitrogen atmosphere. After processing, the hydrocarbon product was condensed and its physical and chemical properties analyzed and total sulphur content determined as recited in Tables 2 and 3, respectively, under the heading 0.20S-III.

Example 4

Russian 0.20 sulphur Gasoil was combined with 1 percent by weight activated carbon as a sensitizer, 2 moles of $CaCO_3$ as the desulphurizing agent, 1.5 moles of $NaBH_4$ as the solid source of hydrogen and 2 moles of NaH, also as a solid source of hydrogen, each per mole of sulphur. The combined product was blanketed under a nitrogen atmosphere for 30 minutes and subjected to microwave irradiation for 6 minutes at a frequency of 2450 MHz at a power level of 1 kW. The product drawn from the microwave reactor was condensed and its physical and chemical properties analyzed as well as its sulphur content as noted in Tables 2 and 3 under the heading 0.20S-Na.

Example 5

Russian 0.20 sulphur Gasoil was combined with 1 percent by weight activated carbon as a sensitizer, 2 moles of $CaCO_3$ as the desulphurizing agent, 1.5 moles of $NaBH_4$ as the solid source of hydrogen and $TiH_2$ as a further source of hydrogen per mole of sulphur. 40 grams of the combined product were blanketed under a nitrogen atmosphere for 30 minutes and subjected to microwave irradiation at a frequency of 2450 MHz at a power level of 1 kW for 6 minutes. The by-product of the irradiation was condensed and its physical and chemical properties analyzed as well as its sulphur content as recited in Tables 2 and 3 under the heading 0.20S-Ti.

It is quite apparent to anyone skilled in this art that although Russian 0.20 sulphur Gasoil in its untreated form would represent a poor if not completely unacceptable fuel source, once subjected to processing pursuant to the present invention, this hydrocarbon meets or exceeds current specifications for diesel fuel. As noted by reference to Table 3, when sodium hydride was employed and used in situ as the solid source of hydrogen, sulphur was completely removed. Analysis for solid sulphur residue, the results of which are presented in Table 4, indicates that most of the sulphur removed in carrying out the present process was in the form of non-toxic inorganic salts. It is further noted that the physical and chemical properties which make any hydrocarbon an acceptable fuel source remain virtually unchanged while the microwave-enhanced purification process described herein is carried out.

TABLE 4

| Parameter | Unit | MDL | Quantity |
|---|---|---|---|
| $SO_3^{2-}$ | % | 0.01 | 1.06 |
| $SO_4^{2-}$ | % | 0.01 | 1.20 |
| $S^{2-}$ | % | 0.02 | 0.10 |
| Total sulphur | % | 0.02 | 0.43 |

Examples 6–9 all employ Russian M-100 fuel oil as the hydrocarbon to be treated. The various additives employed in carrying out the present method are recited in Table 5.

Example 6

Russian M-100 fuel oil was selected as an initial hydrocarbon feed, the physical and chemical properties of which are recited in Table 6. In this instance, this hydrocarbon oil was combined with 1 percent by weight, activated carbon as a sensitizer, 1 weight percent iron powder as a catalyst and two moles of NaOH as a desulphurizing additive per mole of sulphur. 40 grams of the combined product were subjected to a nitrogen atmosphere for 30 minutes and heated to a temperature of 200° C., whereupon it was exposed to a microwave reactor operating at 2450 MHz at a power level of 1 kW for 8 minutes. By-products from this process were condensed and their physical and chemical properties as well as total sulphur level were analyzed and recited at Table 6 while the same condensed products were analyzed for their distributed hydrocarbon fractions as determined by high temperature distillation. These various measured parameters were recited under the heading M-100-I.

TABLE 5

| Reactive Mixtures | C Wt % | Fe wt % | NaOH Mole per mole S | KOH Mole per mole S | $CaCO_3$ Mole per mole S | $NaBH_4$ Mole per mole S | NaH Mole per mole S | $NaHCO_3$ Mole per mole S |
|---|---|---|---|---|---|---|---|---|
| M-100-I | 1 | 1 | 2 | — | — | — | — | — |
| M-100-II | 1 | 1 | 1 | 1 | ½ | ½ | — | 1 |
| M-100-III | 1 | 1 | — | 1 | — | 1 | — | 1 |
| M-100-Na | 1 | 1 | 1 | 1 | 2 | — | 2 | — |

TABLE 6

| Parameter | Units | M-100 (untreated) | M-100-I | M-100-II | M-100-Na | M-100-III |
|---|---|---|---|---|---|---|
| API Gravity | @60° F. | 10.1 | 19.5 | 19.3 | 19.3 | 19.9 |
| Specific Gravity | @60° F. | 0.9993 | 0.937 | 0.938 | 0.938 | 0.935 |
| Density | @20° C. g/cc | 0.9987(@15° C.) | 0.933 | 0.935 | 0.935 | 0.931 |
| Flash Point | ° C. | 128 | 62 | 59 | 59 | 72 |
| Pour Point | ° C. | 0 | 0 | −2 | −2 | −2 |
| Viscosity | Cst@50C | 650 | 11.17 | 11.96 | 11.96 | 12.85 |
| BTU | /lb | 18,437 | 18,860 | 18,883 | 18,883 | 18,850 |
| BTU | /Imp. gal. | 184,241 | 176,718 | 176,556 | 176,556 | 176,813 |
| Sediment | % by vol. | 0.10 | 0.60 | 3.0 | 3.0 | 1.8 |
| Water | % by vol. | 0.03 | 0 | 0 | 0 | 0 |

TABLE 6-continued

| Parameter | Units | M-100 (untreated) | M-100-I | M-100-II | M-100-Na | M-100-III |
|---|---|---|---|---|---|---|
| Bottom Sediment | by volume | 0.13 | 0.60 | 3.0 | — | — |
| Sulphur | % by weight | 3.68 | 3.16 | 2.74 | 1.92 | 2.95 |
| Sulphur removal | % | — | 14.1 | 25.5 | 48 | 19.8 |
| Nitrogen | % by weight | 0.34 | 0.09 | 0.06 | 0.03 | 0.04 |
| Nitrogen removal | % | — | 73.5 | 82.3 | 91.1 | 88.2 |
| Oxygen | % by weight | 1.25 | 0.62 | 0.24 | 0.12 | 0.18 |
| Oxygen removal | % | — | 50.4 | 80.8 | 90.4 | 85.6 |

Example 7

The same M-100 Russian fuel oil was combined with 1 weight percent activated carbon used as a sensitizer, 1 weight percent iron powder as a catalyst, 1 mole of NaOH, 1 mole of KOH, ½ mole of $CaCO_3$ and 1 mole of $NaHCO_3$, as desulphurizing agents per mole of sulphur in the fuel oil feed. The combined product was subjected to a nitrogen atmosphere for 30 minutes whereupon 40 grams of this mixed feed were subjected to microwave energy at 2450 MHz at a power level of 1 kW for 8 minutes. The reaction product was condensed and its physical properties and total sulphur level analyzed and displayed in Table 6 while its distribution of hydrocarbon fractions determined by high temperature distillation recited in Table 7 under the heading M-100-II.

TABLE 7

| % Mass Yield | M-100 Boiling Point ° c. (untreated) | M-100-I Boiling Point ° c. | M-100-II Boiling Point ° c. | M-100-III Boiling Point ° c. |
|---|---|---|---|---|
| 5% | 226 | 180 | 198 | 172 |
| 10% | 256 | 222 | 244 | 215 |
| 20% | 294 | 263 | 270 | 259 |
| 30% | 340 | 300 | 303 | 294 |
| 40% | 432 | 333 | 339 | 314 |
| 50% | 457 | 372 | 383 | 358 |
| 75% | 520 | 467 | 468 | 438 |
| 90% | 558 | 527 | 512 | 512 |
| 96% | 610 | 555 | 557 | 555 |

Example 8

M-100 Russian fuel oil was combined with 1 weight percent activated carbon as a sensitizer, 1 weight percent iron powder as a catalyst, 1 mole of KOH, 1 mole of $CaCO_3$ together with one mole of $NaHCO_3$ employed per mole of sulphur as the desulphurizing agent, together with one half mole of $NaBH_4$ as the solid source of hydrogen. The combined product was subjected to a nitrogen atmosphere for 30 minutes whereupon 40 grams of it were subjected to microwave energy at a frequency of 2450 MHz at a power level of 1 kW for 8 minutes. The reaction product was condensed and its physical properties including total sulphur level and distribution of hydrocarbon fractions as measured by high temperature distillation recited in Table 6 and 7 under the heading M-100-III.

Example 9

M-100 Russian fuel oil was mixed with 1 percent by weight of activated carbon as a sensitizer, 1 percent by weight of iron powder as a catalyst, 1 mole of NaOH, 1 mole of KOH and 2 moles of $CaCO_3$ as desulphurizing agents together with 2 moles of NaH as a solid source of hydrogen, each employed per mole of sulphur. This combined product was subjected to a nitrogen atmosphere for 30 minutes and a 40 gram sample of it irradiated by a microwave reactor operating a 2450 MHz at a power of 1 kW for 8 minutes. The reaction product was condensed and its physical and chemical properties, total sulphur level and distribution of hydrocarbon fractions recited in Table 6 and 7 under the heading M-100-Na.

It is quite apparent, particularly when viewing Table 7, that the distribution of hydrocarbon fractions as determined by high temperature distillation (GC-FID) indicates that the percent of light hydrocarbons increased through the practice of the present invention. As a consequence, various physical and chemical properties which lend themselves to highly desirable fuel oils such as density, viscosity, and flashpoint were greatly improved. In fact, processing of the M-100 Russian fuel oil pursuant to the present invention, resulted in the creation of what can be characterized as a #4 fuel oil or refinery distillate medium fuel. In following the values listed under the heading M-100-Na, it is noted that half of the sulphur and up to 90 percent of nitrogen and oxygen were removed in pursuing the present invention. Further, calorific value of the oil was not changed during microwave treatment.

Example 10

In order to confirm the applicability of the present invention for cracking and desulphurizing heavy waste oils, bunker C oil was mixed with crude oil and subjected to the present invention. Specifically, this combination of hydrocarbons was combined with 2 percent by weight activated carbon as a sensitizer, 1 percent by weight iron powder as a catalyst and 2.4 percent by weight NaOH, 3.4 percent by weight KOH and 6 percent by weight $CaCO_3$ as desulphurizing agents. One kilogram of the described mixed product was subjected to a hydrogen atmosphere for 30 minutes and thereupon exposed to a microwave reactor operating at 915 MHz at a power level of 21 kilowatts for a period of 8 minutes. The reaction product was condensed and its physical and chemical properties as well as total sulphur content were analyzed and the results displayed in Table 8. The same reaction product was analyzed for its distribution of hydrocarbon fractions by high temperature distillation, the results of which are provided in Table 9. As noted, the yield of light hydrocarbons was significant as a result of the practice of the present invention. As such, all of the various physical and chemical properties such as density, gravity, viscosity, flash and pour points were dramatically improved. The final product resulting, from the microwave cracking of the bunker C hydrocarbon starting material, can be classified as #2 refinery light distillate fuel oil. As noted, 83% of the sulphur, 96% of the nitrogen, and 99% of the retained oxygen were removed through this process. Further, the calorific value of the oil was increased.

TABLE 8

Physical properties of the product of microwave cracking of bunker "C" oil and feedstock.

| Parameter | Units | Feedstock | Product |
|---|---|---|---|
| Density @ 20° C. | g/cc | 0.9862 | 0.8608 |
| Gravity, API | | 11.9 | 32.8 |
| Specify Gravity @ 20° C. | | 0.9865 | 0.8612 |
| Appearance | | Dark oil | Dark thin fuel oil |
| Viscosity @ 50° C. | cst | 526.4 | 2.36 |
| Flash point | ° C. | 79 | 21 |
| Pour Point | ° C. | 0 | −39 |
| Heating Value | Btu/lb | 18761 | 19643 |
| Sulphur | % by weight | 1.92 | 0.32 |
| Oxygen | % | 25.8 | 0.2 |
| Nitrogen | % | 6.0 | 0.2 |

TABLE 9

Boiling range distribution of the hydrocarbons in the oil samples before and after treatment under the microwave irradiation (high temperature distillation by GC-FID).

| Hydrocarbon | Boiling point ° C. | Sample before treatment % Mass Yield | Sample after treatment % Mass Yield |
|---|---|---|---|
| C5 | 36 | | 0.7 |
| C6 | 69 | | 1.1 |
| C7 | 98 | | 2.8 |
| C8 | 126 | | 3.4 |
| C9 | 151 | | 5.0 |
| C10 | 174 | 0.8 | 7.2 |
| C11 | 196 | 1.7 | 12.9 |
| C12 | 216 | 6.2 | 20.5 |
| C13 | 235 | 14.2 | 32.8 |
| C14 | 254 | 24.5 | 49.1 |
| C15 | 271 | 40.6 | 64.2 |
| C16 | 287 | 44.1 | 77.3 |
| C17 | 302 | 47.7 | 85.2 |
| C18 | 316 | 53.7 | 91.8 |
| C19 | 330 | 58.1 | 94.4 |
| C20 | 344 | 59.8 | 96.0 |
| C21 | 356 | 66.4 | 96.7 |
| C22 | 369 | 66.9 | 97.3 |
| C23 | 380 | 68.4 | 97.7 |
| C24 | 391 | 72.2 | 98.1 |
| C25 | 401 | 76.0 | 98.5 |

TABLE 9-continued

Boiling range distribution of the hydrocarbons in the oil samples before and after treatment under the microwave irradiation (high temperature distillation by GC-FID).

| Hydrocarbon | Boiling point ° C. | Sample before treatment % Mass Yield | Sample after treatment % Mass Yield |
|---|---|---|---|
| C26 | 412 | 78.8 | 98.7 |
| C27 | 422 | 81.7 | 98.8 |
| C28 | 431 | 82.4 | 98.9 |
| C29 | 440 | 83.6 | 98.9 |
| C30 | 449 | 85.5 | 98.9 |
| C31 | 458 | 86.4 | 99.0 |
| C32 | 466 | 87.4 | 99.1 |
| C34 | 481 | 87.9 | |
| C36 | 496 | 88.1 | |
| C38 | 509 | 88.4 | |
| C40 | 522 | 88.5 | |
| C42 | 534 | 90.8 | |
| C44 | 545 | 93.6 | |
| C46 | 556 | 96.1 | |
| C48 | 566 | 96.3 | |
| C52 | 584 | 96.9 | |
| C56 | 600 | 97.7 | |
| C60 | 615 | 98.1 | |

What is claimed is:

1. A method of desulphurizing and cracking fuel oil comprising first admixing said fuel oil with a sensitizer and solid source of hydrogen to form an admixture followed by subjecting the admixture to microwave energy.

2. The method of claim 1 wherein the sensitizer comprises activated carbon.

3. The method of claim 1 wherein the sensitizer comprises a metal oxide.

4. The method of claim 3 wherein said metal oxide comprises a member selected from the group consisting of NiO, CuO, $Fe_3O_4$, $MnO_2$, $Co_2O_3$ and $WO_3$.

5. The method of claim 1 wherein said sensitizer is incorporated into said admixture in an amount between 0.5 to 20% by weight of said fuel oil.

6. The method of claim 1 wherein said fuel oil is further admixed with a catalyst.

7. The method of claim 6 wherein said catalyst comprises a metal powder.

8. The method of claim 7 wherein said metal powder comprises a member selected from the group consisting of iron, copper and nickel.

9. The method of claim 6 wherein said catalyst is incorporated into said admixture in an amount between approximately 0.5 to 10% by weight of said fuel oil.

10. The method of claim 1 wherein said fuel oil is further admixed with a desulphurizing additive for forming inorganic salts with sulphur contained within said fuel oil.

11. The method of claim 10, wherein said desulphurizing additive forms inorganic salts selected from the group consisting of sulfates, sulfites and sulfides.

12. The method of claim 10 wherein said desulphurizing additive comprises a member selected from the group consisting of $CaCO_3$, granulated limestone, calcite, magnacite, dolomite, NaOH, KOH, and $NaHCO_3$.

13. The method of claim 10 wherein said desulphurizing additive is incorporated into said admixture in an amount between approximately 0.5 to 20% by weight of said fuel oil.

14. The method of claim 1 wherein said solid source of hydrogen comprises a hydride.

15. The method of claim 14 wherein said hydride comprises a member selected from the group consisting of $NaBH_4$, $TiH_2$, KH, CuH, ZnH, NaH, CrH, $NiH_{0.5}$.

16. The method of claim 1 wherein said solid source of hydrogen is incorporated into said admixture in an amount between approximately 0.5 to 20% by weight of said fuel oil.

17. A method of desulphurizing and cracking fuel oil comprising first admixing said fuel oil with a sensitizer, catalyst, desulphurizing additive and solid source of hydrogen to form an admixture followed by subjecting said admixture to microwave energy.

18. The method of claim 17 wherein said sensitizer comprises activated carbon.

19. The method of claim 17 wherein said sensitizer comprises a metal oxide.

20. The method of claim 19 wherein said metal oxide comprises a member selected from the group consisting of NiO, CuO, $Fe_3O_4$, $MnO_2$, $Co_2O_3$, $WO_3$.

21. The method of claim 17 wherein said sensitizer is incorporated into said admixture in an amount between approximately 0.5 to 20% by weight of said fuel oil.

22. The method of claim 17 wherein said catalyst comprises a paramagnetic or ferromagnetic powder.

23. The method of claim 22 wherein said paramagnetic or ferromagnetic powder comprises a member selected from the group consisting of iron, copper and nickel.

24. The method of claim 22 wherein said catalyst is incorporated into said admixture in an amount between approximately 0.5 to 10% by weight of said fuel oil.

25. The method of claim 17 wherein said desulphurizing additive forms inorganic salts with sulphur contained within said fuel oil.

26. The method of claim 25 wherein said desulphurizing additive forms inorganic salts selected from the group consisting of sulfates, sulfites and sulfides.

27. The method of claim 25 wherein said desulphurizing additive comprises a member selected from the group consisting of $CaCO_3$, granulated limestone, calcite, magnecite, dolomite, NaOH, KOH, and $NaHCO_3$.

28. The method of claim 25 wherein said desulphurizing additive is incorporated into said admixture in an amount between approximately 0.5 to 20% by weight of said fuel oil.

29. The method of claim 17 wherein said solid source of hydrogen comprises a hydride.

30. The method of claim 29 wherein said hydride comprises a member selected from the group consisting of $NaBH_4$, $TiH_2$, KH, CuH, ZnH, NaH, CrH and $NiH_{0.5}$.

31. The method of claim 17 wherein said solid source of hydrogen is incorporated into said admixture in an amount between approximately 0.5 to 20% by weight of said fuel oil.

32. A method of desulphurizing and upgrading of hydrocarbon feed stock comprising mixing said hydrocarbon feed stock with a sensitizer, catalyst, desulphurizing agent and non-gaseous source of hydrogen to form an admixture and subjecting said admixture to microwave irradiation for sufficient duration and power to cause release of bound organic sulphur and oxygen from the admixture as inorganic salts.

33. The method of claim 32 wherein nitrogen is released from said admixture as ammonium.

34. The method of claim 32 wherein said admixture is subjected to said microwave irradiation in the substantial absence of hydrogen gas.

35. The method of claim 1 or 17 wherein said fuel oil is heated prior to subjecting said admixture to microwave energy.

* * * * *